US007759875B2

(12) United States Patent
Bai et al.

(10) Patent No.: US 7,759,875 B2
(45) Date of Patent: Jul. 20, 2010

(54) BACKLIGHT MODULE AND CURRENT PROVIDING CIRCUIT THEREOF

(75) Inventors: Shwang-Shi Bai, Tainan County (TW); Hsiu-Na Hsieh, Tainan County (TW); Shu-Ming Chang, Tainan County (TW)

(73) Assignee: Himax Technologies Limited, Tainan County (TW)

( * ) Notice: Subject to any disclaimer, the term of this patent is extended or adjusted under 35 U.S.C. 154(b) by 0 days.

(21) Appl. No.: 12/047,880

(22) Filed: Mar. 13, 2008

(65) Prior Publication Data

US 2008/0265791 A1 Oct. 30, 2008

Related U.S. Application Data

(60) Provisional application No. 60/914,042, filed on Apr. 26, 2007.

(51) Int. Cl.
*H05B 37/02* (2006.01)

(52) U.S. Cl. ..... 315/224; 315/247; 315/276; 315/307

(58) Field of Classification Search ..... 315/209 R, 315/224, 247, 274, 276, 291, 307; 363/21.01, 363/21.1, 21.11, 26, 41
See application file for complete search history.

(56) References Cited

U.S. PATENT DOCUMENTS 6,396,718 B1 * 5/2002 Ng et al. ..... 363/21.07
6,646,897 B1 * 11/2003 Lomax et al. ..... 363/97
7,221,111 B2 * 5/2007 Hirosawa ..... 315/360
7,285,922 B2 * 10/2007 Gong et al. ..... 315/291
2003/0202364 A1 * 10/2003 Lomax et al. ..... 363/21.09
2004/0183507 A1 * 9/2004 Amei ..... 323/222
2005/0141151 A1 * 6/2005 Azodi ..... 361/15
2005/0146907 A1 * 7/2005 Jeon et al. ..... 363/98
2006/0127066 A1 * 6/2006 Chiu et al. ..... 388/804
2006/0138973 A1 * 6/2006 Hirosawa ..... 315/291
2007/0182342 A1 * 8/2007 Hagen et al. ..... 315/274
2007/0188114 A1 * 8/2007 Lys et al. ..... 315/308
2008/0136341 A1 * 6/2008 Araki et al. ..... 315/209 R
2008/0136343 A1 * 6/2008 Yu et al. ..... 315/219

* cited by examiner

*Primary Examiner*—David Hung Vu
*Assistant Examiner*—Tung X Le
(74) *Attorney, Agent, or Firm*—J.C. Patents

(57) ABSTRACT

A backlight module and a current providing circuit thereof are provided. The current providing circuit includes a signal generating unit, a switching unit, a first capacitor, a transformer and an output node. The signal generating unit generates a PWM signal according to a level of a power source. The switching unit determines whether a first signal end and a second signal end of the switching unit are conducted according to the PWM signal received by a control end of the switching unit. Following a switch performed by the switching unit, the first capacitor charges and discharges through a current path provided by a primary coil of the transformer. Thereby, a secondary coil of the transformer generates a corresponding AC voltage by sensing a current change in the primary coil and outputs the AC voltage through the output node.

18 Claims, 3 Drawing Sheets

BACKLIGHT MODULE AND CURRENT PROVIDING CIRCUIT THEREOF

CROSS-REFERENCE TO RELATED APPLICATION

This application claims the priority benefit of U.S.A. provisional application Ser. No. 60/914,042, filed on Apr. 26, 2007, all disclosures are incorporated therewith.

BACKGROUND OF THE INVENTION

1. Field of the Invention

The present invention relates to a backlight module and a current providing circuit thereof, and more particularly to a backlight module of a liquid crystal display (LCD) and a current providing circuit thereof.

2. Description of Related Art

With a progress in computer performance and a rapid development of Internet and multimedia technologies, most image data are transmitted in a digital format rather than in an analog format. Nowadays, flat panel displays including LCDs, organic electroluminescent displays (OLEDs), or plasma display panels (PDPs) which are all developed by combining optoelectronic and semiconductor technologies have gradually replaced conventional CRT displays and have become a mainstream of display devices.

As regards the LCD, a backlight module is required to supply a light source to an LCD panel, for the LCD panel itself is not equipped with a light emitting function. Thereby, images can be displayed on the LCD panel. The light source of the backlight module can be categorized into a cold cathode fluorescence lamp (CCFL) and a light emitting diode (LED). In comparison with the LED, the CCFL characterized by great efficiency and long operational life is extensively adopted by a number of the backlight modules for generating the required light source.

FIG. 1 illustrates a circuit configuration of a conventional backlight module. Referring to FIG. 1, a conventional backlight module 100 drives a CCFL 120 with use of a conventional current providing circuit 110. Here, the conventional current providing circuit 110 includes a switch SW1, a capacitor C1 and a transformer 111. When the conventional backlight module 100 is operated, the switch SW1 determines whether two ends of the switch SW1 are conducted according to a pulse width modulation (PWM) signal PWM1. Following a conduction or a non-conduction of the switch SW1, the capacitor C1 charges and discharges through a current path provided by a primary coil 111*a* of the transformer 111. Thereby, a secondary coil 111*b* of the transformer 111 generates an AC voltage to drive the CCFL 120 according to a current change in the primary coil 111*a*.

Note that the conventional current providing circuit 110 continuously receives the PWM signal PWM1 having a constant frequency. Hence, as a level of a power source Vcc varies, a conversion efficiency of the switch SW1 is correspondingly changed. Relatively, the power consumption of the conventional current providing circuit 110 is then increased, further resulting in a reduction of the operational life of the conventional backlight module 100 and a deteriorated display quality of the display. As a result, for manufacturers of the backlight modules, one of the major issues with respect to the development of the backlight modules lies in a way to effectively improve the conversion efficiency of the switch SW1 for reducing the power consumption of the current providing circuit.

SUMMARY OF THE INVENTION

The present invention is directed to a current providing circuit in which the power consumption thereof is reduced by constantly optimizing a conversion efficiency of a switching unit.

The present invention is further directed to a backlight module in which the operational life of a circuit is extended with use of a current providing circuit characterized by low power consumption.

The present invention provides a current providing circuit including a signal generating unit, a switching unit, a first capacitor, a transformer and an output node. The signal generating unit generates a PWM signal according to a level of a power source. The switching unit determines whether a first signal end and a second signal end of the switching unit are conducted according to the PWM signal received by a control end of the switching unit. Following a conduction or a non-conduction of the first and the second signal ends of the switching unit, the first capacitor charges and discharges through a current path provided by a primary coil of the transformer. Thereby, a secondary coil of the transformer generates a corresponding AC voltage by sensing a current change in the primary coil. Finally, the current providing circuit is able to output the AC voltage through the output node.

Note that a duty cycle of the PWM signal is inversely proportional to the level of the power source according to an embodiment of the present invention. Based on the above, the switching unit controlled by the PWM signal can have a constantly optimized conversion efficiency.

According to an embodiment of the present invention, the signal generating unit includes a voltage controlled oscillator and a PWM circuit. The voltage controlled oscillator is used for generating an oscillation signal whose frequency is proportional to the level of the power source. On the other hand, the PWM circuit is utilized for generating the PWM signal according to the frequency of the oscillation signal. In view of the above, the frequency of the PWM signal is proportional to the level of the power source.

The present invention also provides a backlight module including a light source and a current providing circuit. The current providing circuit includes a signal generating unit, a switching unit, a first capacitor, a transformer and an output node. The signal generating unit generates a PWM signal according to a level of a power source. The switching unit determines whether a first signal end and a second signal end of the switching unit are conducted according to the PWM signal received by a control end of the switching unit. Following a conduction or a non-conduction of the first and the second signal ends of the switching unit, the first capacitor charges and discharges through a current path provided by a primary coil of the transformer. Thereby, a secondary coil of the transformer generates a corresponding AC voltage by sensing a current change in the primary coil. Finally, the current providing circuit is able to output the AC voltage through the output node and to drive the light source with use of the AC voltage.

In the present invention, the conversion efficiency of the switching unit is constantly optimized with use of the signal generating unit, and accordingly the power consumption of the current providing circuit is effectively reduced. Besides, the operational life of the backlight module is correspondingly increased.

In order to make the aforementioned and other objects, features and advantages of the present invention more comprehensible, an embodiment accompanied with figures is described in detail below.

DESCRIPTION OF EMBODIMENTS

One of the main technical features of the present invention lies in that a conversion efficiency of a switching unit can be constantly optimized with use of a PWM signal whose frequency may be changed along with a variation of a power source Vcc. Thereby, the power consumption of a current providing circuit is reduced, and the operational life of a backlight module is effectively extended. The backlight module and the current providing circuit thereof in the present invention are exemplified hereinafter. However, the following embodiment is not intended to limit the scope of the present invention. Those skilled in the art can make appropriate modifications to the following embodiments without departing from the spirit of the present invention.

Figure 1:
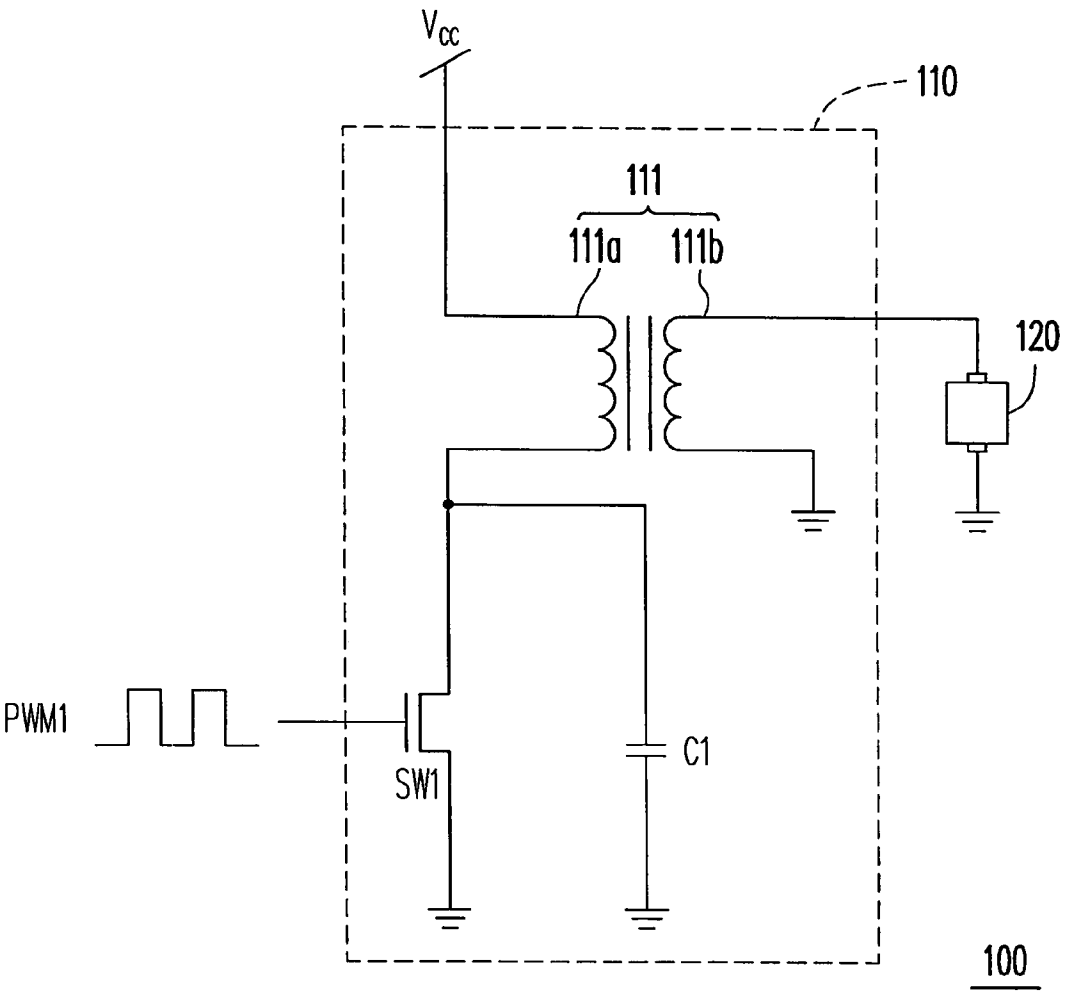
FIG. 1 (PRIOR ART)
FIG. 1 illustrates a circuit configuration of a conventional backlight module.
Figure 2:
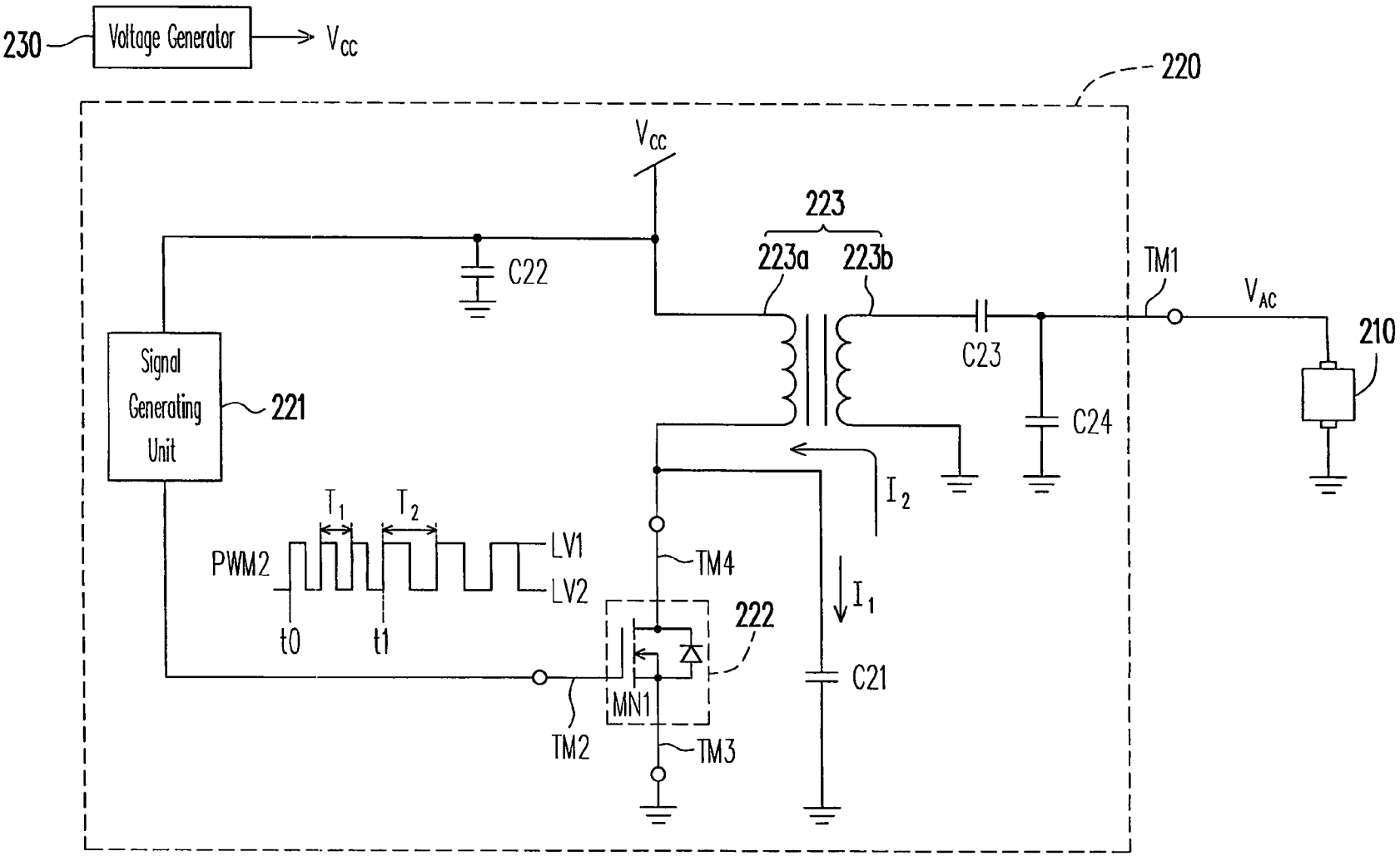
FIG. 2 illustrates a circuit configuration of a backlight module according to an embodiment of the present invention.

FIG. 2 illustrates a circuit configuration of a backlight module according to an embodiment of the present invention. Referring to FIG. 2, a backlight module 200 includes a light source 210 and a current providing circuit 220. The current providing circuit 220 includes a signal generating unit 221, a switching unit 222, a transformer 223, a capacitor C21 and an output node TM1. Here, the light source 210 is coupled to the output node TM1 of the current providing circuit 220. A control end TM2 of the switching unit 222 is coupled to the signal generating unit 221, whereas a signal end TM3 of the switching unit 222 is coupled to a ground end. The capacitor C21 is coupled between another signal end TM4 of the switching unit 222 and the ground end. A primary coil 223*a* of the transformer 223 is coupled to a power source $V_{CC}$ and the switching unit 222, while a secondary coil 223*b* thereof is coupled to the output node TM1.

In general, the signal generating unit 221 generates a PWM signal PWM2 according to a level of the power source $V_{CC}$. On the other hand, the switching unit 222 receives the PWM signal PWM2 through the control end TM2 and determines whether the two signal ends TM3 and TM4 of the switching unit 222 are conducted according to the PWM signal PWM2. Following the change of a conducting state between the two signal ends TM3 and TM4 of the switching unit 222, the capacitor C21 charges and discharges through a current path provided by the primary coil 223*a* of the transformer 223.

For example, as shown in FIG. 2, if the switching unit 222 includes an N-type transistor MN1, the switching unit 222 conducts its two signal ends TM3 and TM4 when a level of the PWM signal PWM2 is switched to a high level LV1. Here, the capacitor C21 charges through the current path provided by the primary coil 223*a*, and thereby a current $I_1$ is generated during the charging process. By contrast, as the level of the PWM signal PWM2 is switched to a low level LV2, the two signal ends TM3 and TM4 of the switching unit 222 are not conducted. Here, the capacitor C21 discharges through the current path provided by the primary coil 223*a*, and thereby a current $I_2$ is generated during the discharging process.

In detail, since current directions of the currents $I_1$ and $I_2$ passing through the primary coil 223*a* are opposite to each other, a polarity of the voltage at the first primary coil 223*a* accordingly varies with time. Thereby, the secondary coil 223*b* generates a corresponding AC voltage $V_{AC}$ by sensing the current passing through the primary coil 223*a*. In addition, the current providing circuit 220 outputs the AC voltage $V_{AC}$ through the output node TM1, so as to drive the light source 210 by using the AC voltage $V_{AC}$.

It should be noted that a duty cycle of the PWM signal PWM2 generated by the signal generating unit 221 is inversely proportional to the level of the power source $V_{CC}$. For example, as a beginning time is defined as $t_0$, the duty cycle of the PWM signal PWM2 is T1. When the level of the power source Vcc is decreased at a time $t_1$ as time passes by, the duty cycle of the PWM signal PWM2 is immediately changed to T2 by the signal generating unit 221. Here, $T_2>T_1$.

Thus, when the level of the power source Vcc is increased as time goes by, the frequency of the PWM signal PWM2 utilized for controlling the switching unit 222 is correspondingly increased. On the contrary, when the level of the power source Vcc is decreased as time goes by, the frequency of the PWM signal PWM2 used for controlling the switching unit 222 is correspondingly decreased. Based on the above, the conversion efficiency of the switching unit 222 is constantly optimized, and accordingly the power consumption of the current providing circuit 220 is effectively reduced. Besides, the operational life of the backlight module 200 is correspondingly increased.

Referring to FIG. 2, the backlight module 200 further includes a voltage generator 230. The voltage generator 230 generates the power source $V_{CC}$ such that the current providing unit 220 is able to be operated by the power source $V_{CC}$. Note that people skilled in the art may, based on design demands, change a position where the voltage generator 230 is disposed. For example, people skilled in the art may dispose the voltage generator 230 in the current providing circuit 220.

The current providing circuit 220 further includes capacitors C22~C24. The capacitor C22 is coupled between the power source Vcc and the ground end. The capacitor C23 is coupled to the secondary coil 223*b* and the output node TM1. The capacitor C24 is coupled between the output node TM1 and the ground end. Here, the capacitor C22 filters ripples in the power source Vcc, such that a relatively stable power source Vcc may be received by the current providing circuit 220. On the other hand, the capacitors C23 and C24 are utilized to correct a waveform of the AC voltage $V_{AC}$, such that the waveform of the AC voltage $V_{AC}$ tends to become a pure sine waveform.

It should be noted that the light source 210 exemplified in the present embodiment is a fluorescent lamp including a CCFL or a flat fluorescent lamp. Besides, in order to make those skilled in the art easily implement the present invention, a detailed description in relation to the signal generating unit 221 is provided hereinafter.

Figure 3:
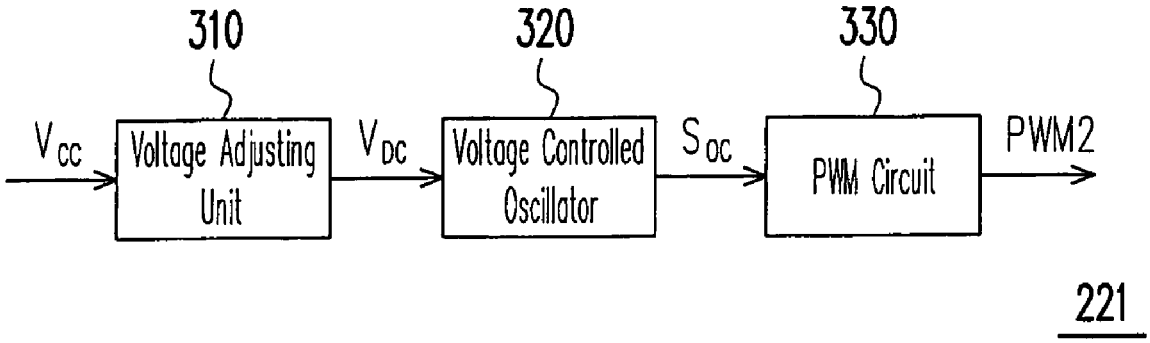
FIG. 3 illustrates a circuit configuration of a signal generating unit according to an embodiment of the present invention.

FIG. 3 illustrates a circuit configuration of a signal generating unit according to an embodiment of the present invention. Referring to FIG. 3, the signal generating unit 221 includes a voltage adjusting unit 310, a voltage controlled oscillator 320, and a PWM circuit 330.

The voltage adjusting unit 310 adjusts the level of the power source $V_{CC}$ with a scaling factor and outputs an adjusted DC voltage $V_{DC}$ to the voltage controlled oscillator 320. Thereby, the voltage controlled oscillator 320 generates an oscillation signal $S_{OC}$ based on a level of the DC voltage $V_{DC}$, and the frequency of the oscillation signal $S_{OC}$ is proportional to the level of the DC voltage $V_{DC}$. Moreover, when the voltage adjusting unit 310 operates, the level of the DC voltage $V_{DC}$ is proportional to the level of the power source Vcc. Accordingly, the frequency of the oscillation signal $S_{OC}$ is proportional to the level of the power source Vcc.

Figure 4:
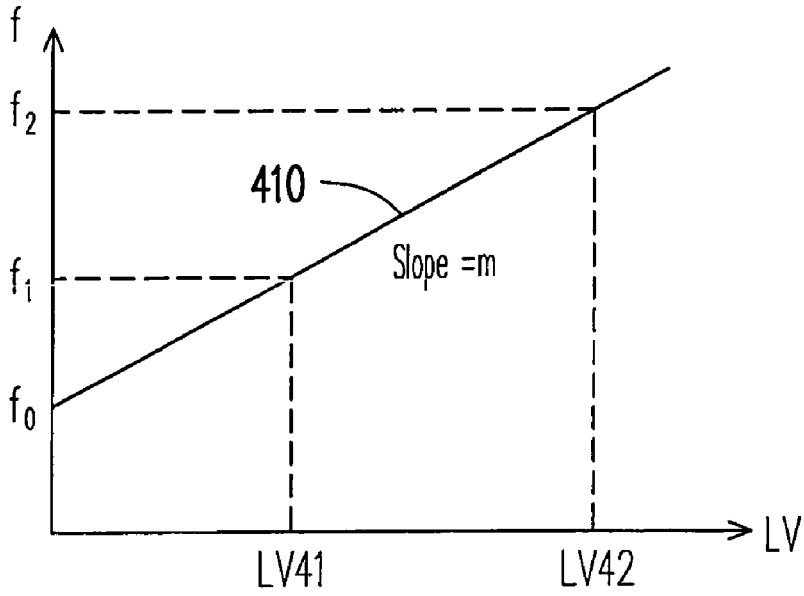
FIG. 4 is a curve diagram illustrating the embodiment depicted in FIG. 3.

On the other hand, the PWM circuit 330 generates the PWM signal PWM2 according to the frequency of the oscillation signal $S_{OC}$. It should be noted that the frequency of the oscillation signal $S_{OC}$ is proportional to the level of the power source Vcc. Hence, the frequency of the PWM signal PWM2 generated by the PWM circuit 330 is also in proportion to the level of the power source Vcc. In other words, as illustrated in FIG. 4, the frequency f of the PWM signal PWM2 and the level LV of the power source Vcc may be represented by the following formulas (1) and (2):

$$f = f_0 + m \times LV \tag{1}$$

$$m = \frac{f_2 - f_1}{LV_{42} - LV_{41}} \tag{2}$$

Here, $f_0$ is a constant, and m is a slope of a line segment 410. Additionally, when the level of the power source Vcc is set as LV41, the frequency of the PWM signal PWM2 is $f_1$. On the other hand, when the level of the power source Vcc is defined as LV42, the frequency of the PWM signal PWM2 is $f_2$.

In light of the foregoing, with use of the signal generating unit of the present invention, the frequency of the PWM signal is proportional to the level of the power source. Thereby, the conversion efficiency of the switching unit controlled by the PWM signal is constantly optimized, and accordingly the power consumption of the current providing circuit is effectively reduced. Besides, the operational life of the backlight module is correspondingly increased.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A current providing circuit, comprising:

a transformer, having a primary coil and a secondary coil, wherein a first end of the primary coil receives a power source;

a signal generating unit, coupled to the first end of the primary coil so as to generate a pulse width modulation (PWM) signal according to a level of the power source, wherein the signal generating unit increases a frequency of the PWM signal with increasing of the level of the power source, and the signal generating unit decreases the frequency of the PWM signal with decreasing of the level of the power source;

a switching unit, having a control end, a first signal end and a second signal end, wherein the first signal end is coupled to a second end of the primary coil, the second signal end is coupled to a ground end, and the switching unit determines whether the first signal end and the second signal end are conducted according to the PWM signal received by the control end;

a first capacitor, coupled between the first signal end and the ground end; and an output node, coupled to the secondary coil for outputting an AC voltage.

2. The current providing circuit as claimed in claim 1, wherein the signal generating unit comprises:

a voltage controlled oscillator, for generating an oscillation signal, wherein the frequency of the oscillation signal is proportional to the level of the power source; and a PWM circuit, for generating the PWM signal according to the frequency of the oscillation signal.

3. The current providing circuit as claimed in claim 2, wherein the signal generating unit further comprises:

a voltage adjusting unit, for adjusting the level of the power source with a scaling factor, and outputting an adjusted DC voltage to the voltage controlled oscillator.

4. The current providing circuit as claimed in claim 1, wherein the switching unit comprises an N-type transistor.

5. The current providing circuit as claimed in claim 1, further comprising:

a second capacitor, coupled to the secondary coil and the output node; and a third capacitor, coupled between the output node and the ground end, wherein the second capacitor and the third capacitor are used for correcting waveforms of the AC voltage.

6. The current providing circuit as claimed in claim 1, further comprising:

a fourth capacitor, coupled between the power source and the ground end.

7. The current providing circuit as claimed in claim 1, further comprising:

a voltage generator, for generating the power source.

8. The current providing circuit as claimed in claim 1, wherein a duty cycle of the PWM signal is inversely proportional to the level of the power source.

9. A backlight module, comprising:

a light source; and a current providing circuit, coupled to the light source, comprising:

a transformer, having a primary coil and a secondary coil, wherein a first end of the primary coil receives a power source;

a signal generating unit, coupled to the first end of the primary coil so as to generate a PWM signal according to a level of the power source, wherein the signal generating unit increases a frequency of the PWM signal with increasing of the level of the power source, and the signal generating unit decreases the frequency of the PWM signal with decreasing of the level of the power source;

a switching unit, having a control end, a first signal end and a second signal end, wherein the first signal end is coupled to a second end of the primary coil, the second signal end is coupled to a ground end, and the switching unit determines whether the first signal end and the second signal end are conducted according to the PWM signal received by the control end;

a first capacitor, coupled between the first signal end and the ground end; and an output node, coupled to the secondary coil for outputting an AC voltage.

10. The backlight module as claimed in claim 9, wherein the signal generating unit comprises:

a voltage controlled oscillator, for generating an oscillation signal, wherein the frequency of the oscillation signal is proportional to the level of the power source; and a PWM circuit, for generating the PWM signal according to the frequency of the oscillation signal.

11. The backlight module as claimed in claim 10, wherein the signal generating unit further comprises:

a voltage adjusting unit, for adjusting the level of the power source with a scaling factor, and outputting an adjusted DC voltage to the voltage controlled oscillator.

12. The backlight module as claimed in claim 9, wherein the switching unit comprises an N-type transistor.

13. The backlight module as claimed in claim 9, wherein the current providing circuit further comprises:

a second capacitor, coupled to the secondary coil and the output node; and a third capacitor, coupled between the output node and the ground end, wherein the second capacitor and the third capacitor are used for correcting waveforms of the AC voltage.

14. The backlight module as claimed in claim 9, wherein the current providing circuit further comprises:

a fourth capacitor, coupled between the power source and the ground end.

15. The backlight module as claimed in claim 9, further comprising:

a voltage generator, for generating the power source.

16. The backlight module as claimed in claim 9, wherein a duty cycle of the PWM signal is inversely proportional to the level of the power source.

17. The backlight module of claim 9, wherein the light source is a fluorescent lamp.

18. The backlight module as claimed in claim 17, wherein the fluorescent lamp comprises a cold cathode fluorescent lamp (CCFL) or a flat fluorescent lamp.

* * * * *